US005983502A

United States Patent [19]

Geertsma et al.

[11] Patent Number: 5,983,502

[45] Date of Patent: Nov. 16, 1999

[54] SHAVING APPARATUS

[75] Inventors: Geert Geertsma, Drachten, Netherlands; Teruo Hishiki, Tokyo, Japan; Akinori Takie, Tokyo, Japan; Yoshihiro Shibuya, Tokyo, Japan

[73] Assignee: U.S. Philips Corporation, New York, N.Y.

[21] Appl. No.: 08/988,594

[22] Filed: Dec. 11, 1997

[30] Foreign Application Priority Data

Dec. 20, 1996 [EP] European Pat. Off. ..... 962036448

[51] Int. Cl.[6] ..... B26B 19/38

[52] U.S. Cl. ..... 30/43.6; 30/43

[58] Field of Search ..... 30/34.05, 41.8, 30/43.6, 537, 527

[56] References Cited

U.S. PATENT DOCUMENTS

| | | | |
|---|---|---|---|
| 3,274,682 | 9/1966 | Worthington | 30/34.05 |
| 3,844,033 | 10/1974 | Yonkers | 30/43.6 |
| 4,038,748 | 8/1977 | Tyler | 30/43.6 |
| 4,531,287 | 7/1985 | Shibata et al. | 30/34.05 |
| 4,774,765 | 10/1988 | Ferraro | 30/527 |
| 5,058,270 | 10/1991 | Deubler et al. | 30/34.05 |
| 5,119,558 | 6/1992 | Van Erp et al. | 30/43.6 |
| 5,165,170 | 11/1992 | Sagol et al. | 30/34.05 |
| 5,167,069 | 12/1992 | Quinn | 30/527 |
| 5,343,621 | 9/1994 | Hildebrand et al. | 30/527 |

*Primary Examiner*—Douglas D. Watts
*Assistant Examiner*—Gyounghyun Bae
*Attorney, Agent, or Firm*—Ernestine C. Bartlett

[57] ABSTRACT

The invention relates to a shaving apparatus comprising a housing (1) and at least one hair-cutting member (6). In order to prevent a user from irritating and injuring the skin during shaving, as far as possible, the shaving apparatus comprises means for warning the user when a given preset force is exceeded. The means can be, for example, one or more sensors which measure the force between the hair-cutting member and the housing during shaving. The sensor can be, for example, a Hall sensor (21), which is secured to the housing and which cooperates with an annular magnet (19), which is secured to a coupling pin (11) for driving the rotary hair-cutting member (6). The invention can also be used in wet-shavers.

8 Claims, 4 Drawing Sheets

SHAVING APPARATUS

BACKGROUND OF THE INVENTION

The invention relates to a shaving apparatus comprising a housing and at least one hair-cutting member.

During shaving a user will try to avoid skin irritation and skin injury as far as possible. Skin irritation and injury occur when the hair-cutting member comes too intensively into contact with the skin, which occurs particularly when the user presses the hair-cutting member against the skin with excessive force. This can occur during use of wet-shavers as well as electric dry-shavers, and particularly when a user switches from one system to the other or in the case of an inexperienced user. In the initial period it is important that the user does not press the shaving apparatus against the skin with excessive force.

SUMMARY OF THE INVENTION

It is an object of the invention to provide a shaving apparatus which as far as possible prevents the user from irritating and injuring the skin during shaving.

To this end the shaving apparatus in accordance with the invention is characterized in that the shaving apparatus comprises means for warning the user when a given preset force between the hair-cutting member and the housing is exceeded during shaving.

Such a device can produce an optical or acoustic signal when the pressure exceeds a given value and thus warns the user to reduce the pressure in order to preclude or stop skin irritation and injury.

The means for warning may comprise a sensor for measuring the force between the hair-cutting member and the housing during shaving. The means may alternatively comprise a pressure-contact switch, which is arranged in the housing and whose electrical contacts are influenced by the position of the hair-cutting member with respect to the housing. When a given force is exceeded, which generally corresponds to a given depression depth of the haircutting member with respect to the housing, the user is warned by means of, for example, a buzzer via a control circuit.

A preferred embodiment of an electric dry-shaving apparatus is characterized in that the apparatus comprises at least one hair-cutting unit which is resiliently supported with respect to the housing, which hair-cutting unit comprises an external haircutting member having hair-entry apertures and an internal hair-cutting member which is drivable with respect to the external hair-cutting member, which internal hair-cutting member is driven by a motor via a coupling pin, the sensor comprising a magnet, which is secured to the coupling pin, and a Hall sensor, which is disposed underneath the magnet and which is secured in the housing.

Such a construction can be used both in the case of a vibratory shaving apparatus and in the case of a rotary shaving apparatus. Obviously, it is also possible to provide the cutting member or cutting members of a wet-shaving apparatus with a sensor which gives a signal in the case of an excessive pressure.

By providing the shaving apparatus with a switch for the activation of the sensor, the user himself can determine whether or not he wishes to use the excess-pressure function. Such a shaving apparatus may further include a counting device for counting the number of times that the preset force has been exceeded. After a certain time the user has learned to press the shaving apparatus not too firmly against the skin. The number of times that the force is exceeded decreases.

He can then disable the function or keep it activated for safety. Alternatively, the shaving apparatus can be constructed in such a manner that the function is disabled automatically after a given number of shaves. However, it should, of course, be possible to reactivate the function if the user wishes to do so.

BRIEF DESCRIPTION OF THE DRAWINGS

The invention will now be described in more detail with reference to an embodiment shown by way of example in the drawings. In the drawings

DESCRIPTION OF THE PREFERRED EMBODIMENTS

Figure 1:
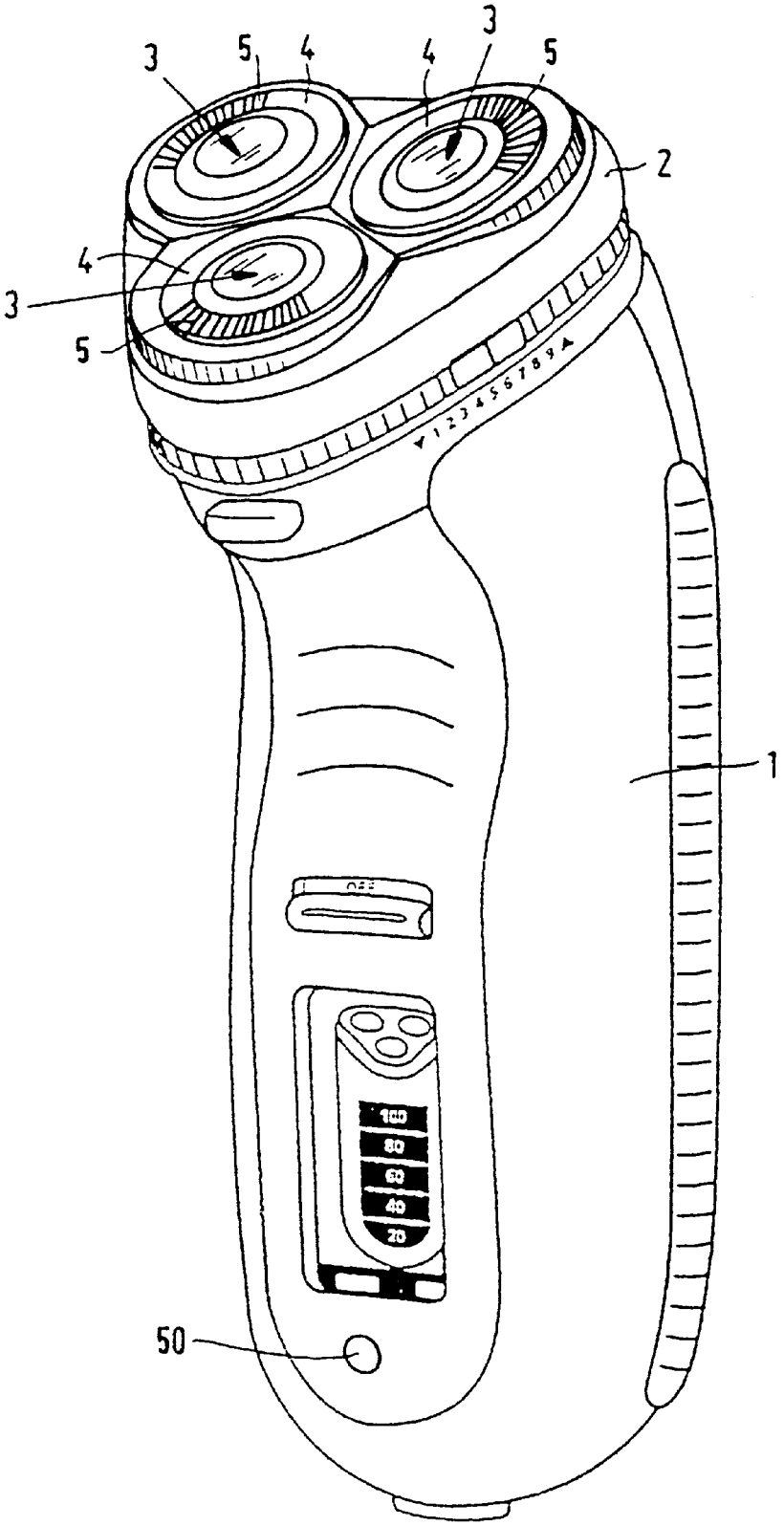
FIG. 1 shows a shaving apparatus of the rotary type.
Figure 2:
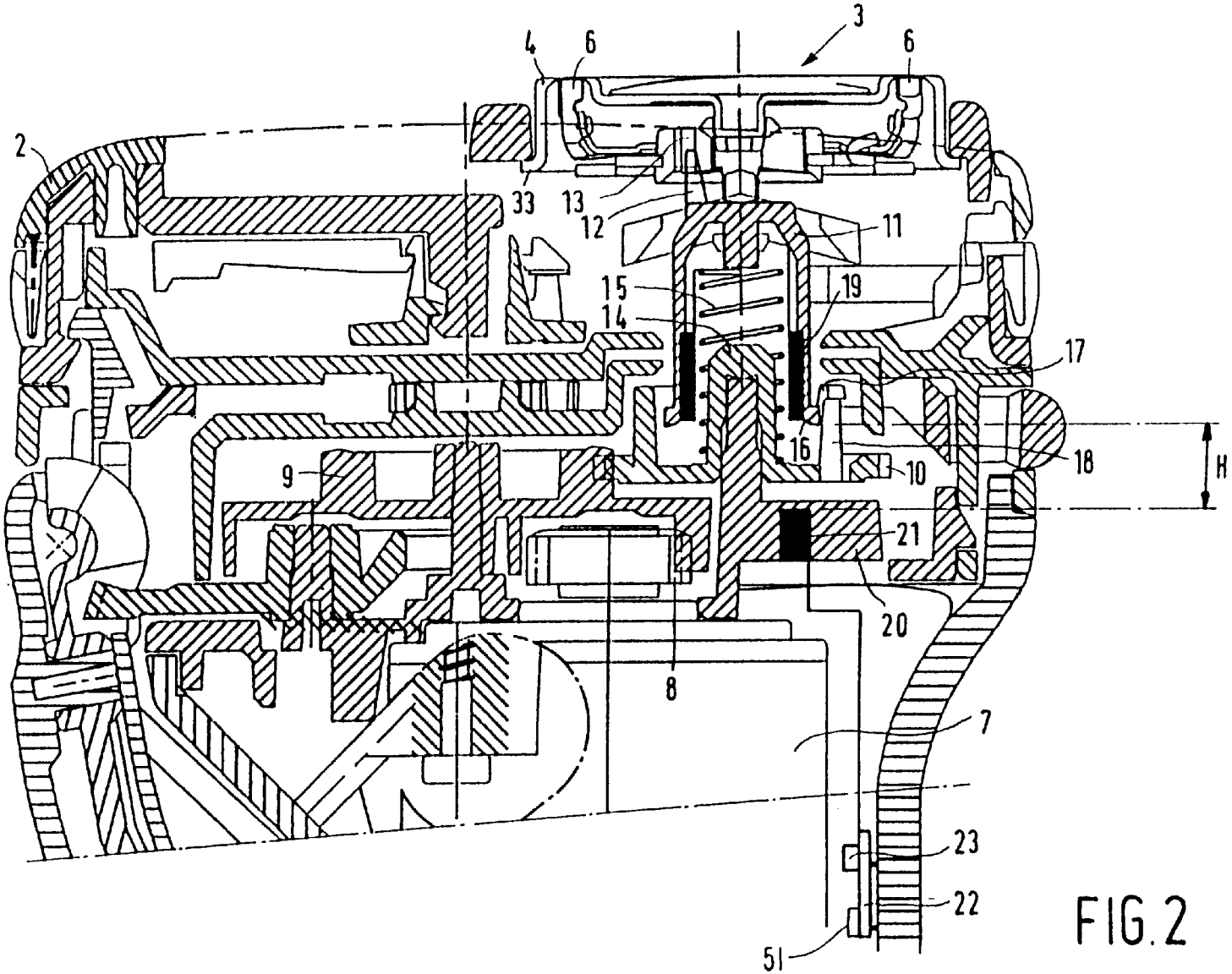
FIG. 2 shows a part of the shaving head of the shaving apparatus shown in FIG. 1, with a first construction for a sensor.

The rotary shaving apparatus shown in FIGS. 1 and 2 comprises a housing 1 having a holder 2 which is detachable from or hingeable with respect to the housing. The holder holds three cutting units 3, each having an external hair-cutting member 4 with hair-entry entry apertures 5 and an internal hair-cutting member 6, which is rotationally drivable with respect to said external hair-cutting member. The housing accommodates a motor 7, which drives a coupling pin 11 via gear wheels 9, 10. When the holder 2 is placed onto the housing the projections 12 of the coupling pin 11 engage openings 13 in the internal hair-cutting member 6, thereby enabling the internal hair-cutting member 6 to be driven with respect to the external hair-cutting member 4. The coupling pin 11 is sleeve-shaped and has an open end remote from the cutting unit 3. The open end fits onto a hub 14 of the gear wheel 10. A spring 15 acts between the coupling pin 11 and the gear wheel 10. The lower edge of the coupling pin has outwardly directed projections 16, which engage in vertical grooves 17 in a flange 18 of the gear wheel 10. Thus, the coupling pin is fixedly coupled to the gear wheel in the direction of rotation but is axially movable with respect to the gear wheel against the force of the spring 15. Thus, the cutting unit 3, including the coupling pin 11, is resiliently depressible with respect to the holder 2 and the housing 1.

At its end which faces the gear wheel 10 the sleeve-shaped coupling pin 11 carries an annular permanent magnet 19. A plate 20, which is fixedly secured to the housing, is disposed underneath the gear wheel 10. In this plate 20 a Hall sensor 21 is mounted underneath the annular magnet 19. The Hall sensor is thus situated in the vicinity of the magnetic field of the magnet 19. There is a direct relationship between the force with which the cutting unit is depressed (spring force) relative to the housing (holder) and the distance H between the magnet 19 and the sensor 21. The distance between the magnet and the sensor decreases as the cutting unit is depressed further. The Hall sensor is connected to an electronic circuit 22 which has been adjusted in such a way that a warning signal is produced when a given distance, i.e. pressure, is exceeded. This can be effected by means of, for example, a buzzer. In this way, a sensor can be provided for each cutting-unit in, for example, a triple-head shaving apparatus.

Figure 3:
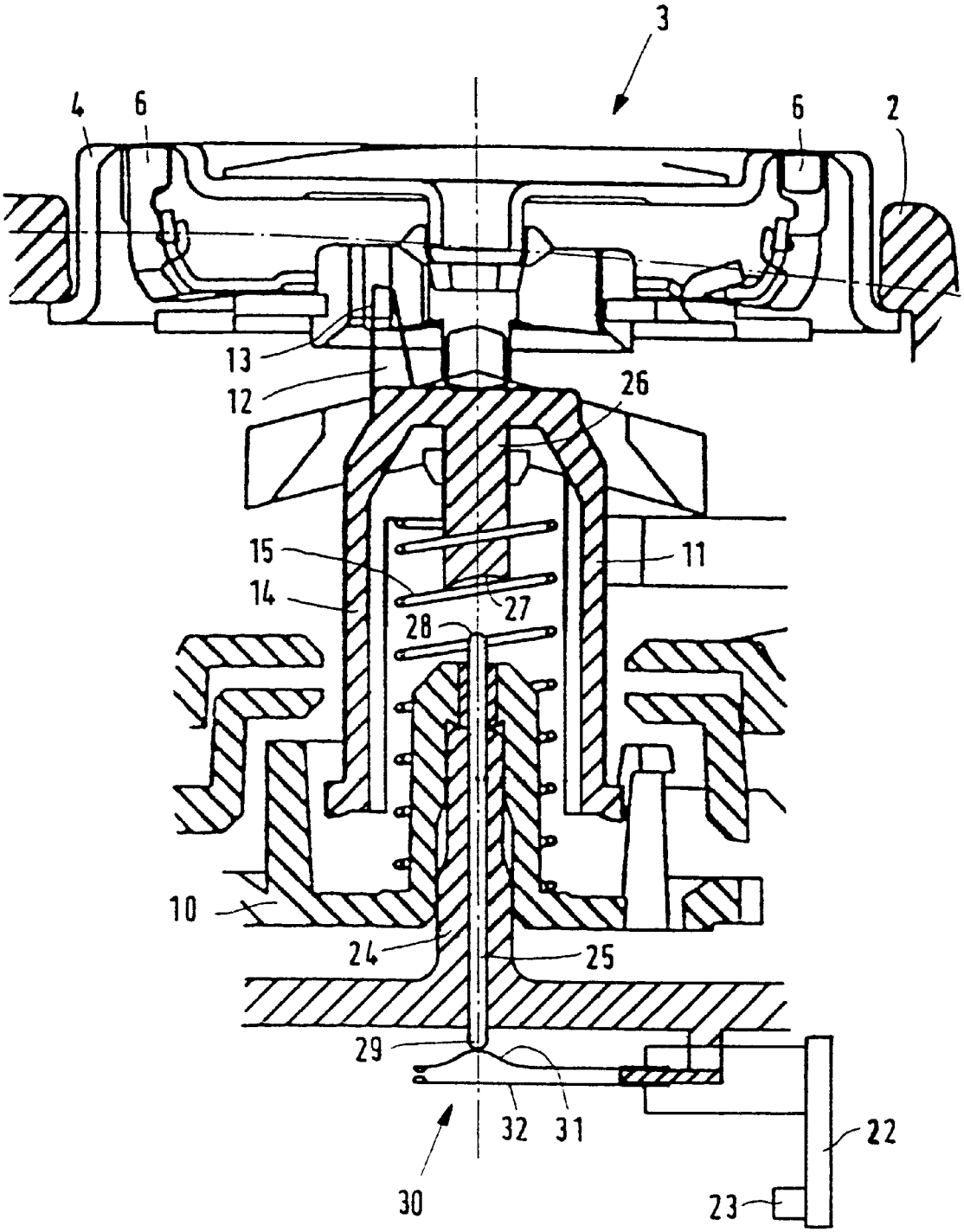
FIG. 3 shows a part of the shaving head of the shaving apparatus shown in FIG. 1, with a second construction for a sensor.

The detailed drawing in FIG. 3 shows an alternative sensor. In the bearing spindle 24 carrying the gear wheel 10 a pin 25 has been mounted so as to be slidable in the bearing spindle. A projection 26 in the sleeve-shaped coupling pin 11 has a free end 27 situated opposite the upper end 28 of the pin 25. The lower end 29 of the pin bears upon a resilient contact lug 31 of a pressure switch 30. A fixed contact lug 32 is disposed underneath the resilient contact lug. Both contact lugs are electrically connected to a control circuit 22. When during shaving the coupling pin is pressed inward against the force of the spring 15 down to a given distance corresponding to a given pressure of the cutting unit on the skin, the pin 25 is pressed downward against the resilient contact lug 31 of the pressure switch 30, which subsequently makes contact with the fixed lug 32, as a result of which a buzzer 23 is activated via the control circuit.

Figure 4:
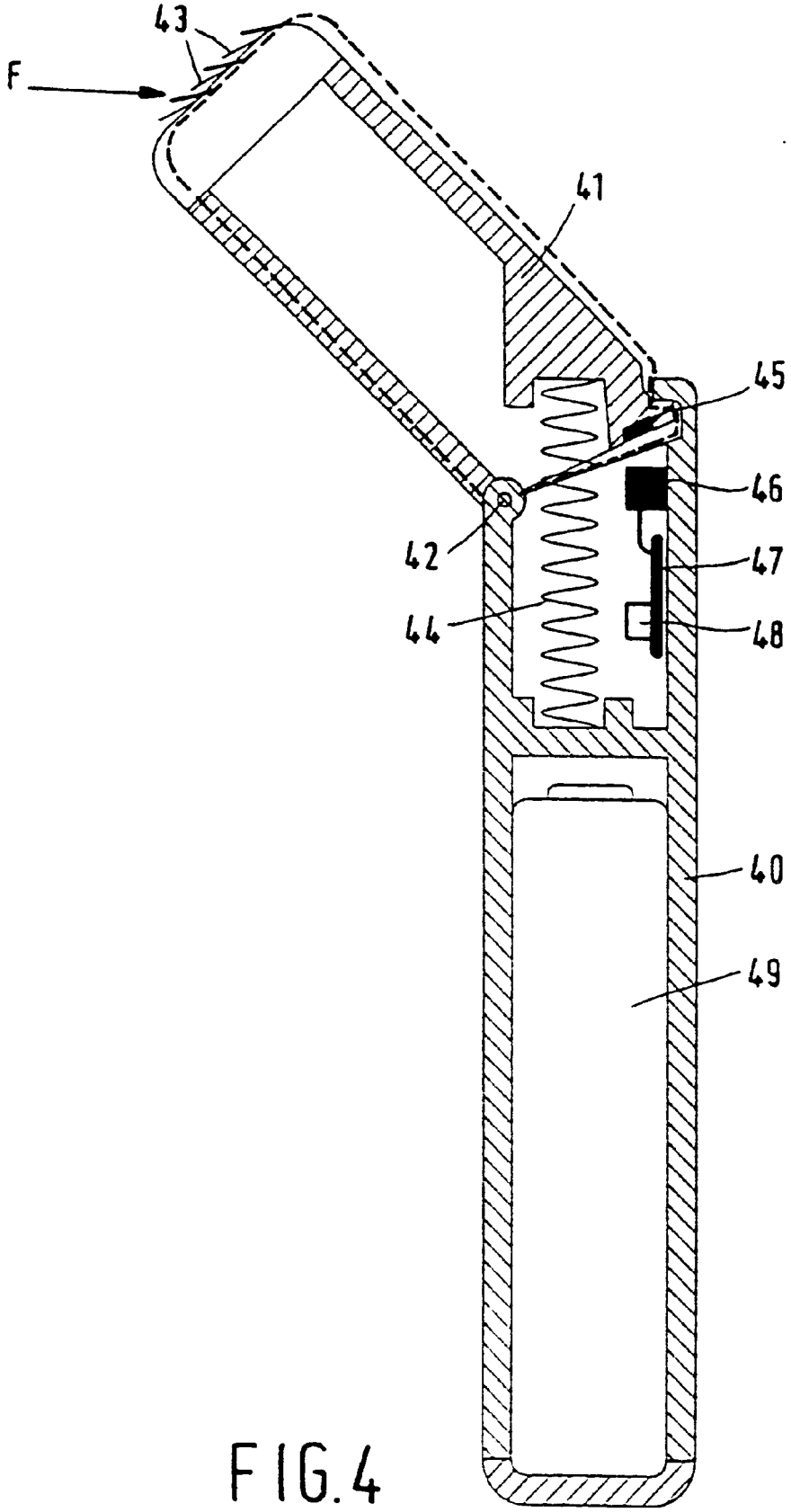
FIG. 4 shows a wet-shaving apparatus.

FIG. 4 shows a wet-shaving apparatus comprising a housing 40, which serves as a handle, and a shaving head 41, which is pivotably connected to the housing by means of a hinge 42. The shaving head 41 comprises one or more wet-shaving blades 43. A pressure spring 44 acts between the shaving head and the housing. During shaving a pressure F is produced, as a result of which the shaving head can pivot with respect to the housing (handle), as is indicated by a broken line. To warn against an excessive pressure of the blades on the skin, the shaving head has been provided with a permanent magnet 45 and the housing of a Hall sensor 46. The operation of these elements corresponds to the operation as described for the rotary shaving apparatus in accordance with FIGS. 1 and 2. As the pressure F increases the shaving head pivots in such a manner that the distance between the magnet and the sensor decreases accordingly. When a given pressure or distance is exceeded a warning signal is produced, for example, by means of a buzzer 46 via the electronic control circuit 47. A battery 49 provides the power supply for the electronic control circuit.

It is also possible to arrange a sensor underneath the lower edge 33 (see FIG. 2) of the external cutting member 4. The sensor is then, for example, fixedly connected to the housing 1. When the external cutting member is pressed inward too far, the lower edge of the cutting member comes into contact with the sensor and a warning signal is produced. This example is not elaborated any further.

Obviously, the sensors described above can also be used in a dry-shaving apparatus of the vibratory type, for example a shaving apparatus in which the internal cutting member performs a reciprocating movement.

It is also possible to use sensors of different types, such as a magneto-resistive sensor instead of a Hall sensor in a magnetic field, a capacitive sensor, an inductive sensor, or an optical sensor. When an optical sensor is used the sensor should be arranged in a space which is dust-proof as far as possible.

By means of a switch 50 shown in FIG. 1 the warning system can be turned on or turned off, as desired, via the control circuit. By means of a counting device 51 in the control circuit it is possible to count how many times the preset force has been exceeded, thus enabling the warning system to be disabled automatically after the force has been exceeded a given number of times.

We claim:

1. A shaving apparatus comprising a housing and at least one hair-cutting member, wherein the shaving apparatus comprises means for warning the user when a given preset force between the hair-cutting member and the housing is exceeded during shaving when the user presses the hair-cutting member against the skin.

2. A shaving apparatus as claimed in claim 1, characterized in that the means comprise a sensor for measuring the force between the hair-cutting member and the housing during shaving.

3. A shaving apparatus as claimed in claim 2, wherein the apparatus comprises at least one hair-cutting unit which is resiliently supported relative to the housing, which hair-cutting unit comprises an external hair-cutting member having hair-entry apertures and an internal hair-cutting member which is drivable with respect to the external hair-cutting member, which internal hair-cutting member is driven by a motor via a coupling pin, the sensor comprising a magnet, secured to the coupling pin, and a Hall sensor, which is disposed underneath the magnet and which is secured in the housing.

4. A shaving apparatus as claimed in claim 2, wherein the apparatus comprises at least one hair-cutting unit which is resiliently supported relative to the housing, which hair-cutting unit comprises an external hair-cutting member having hair-entry apertures and an internal hair-cutting member which is drivable with respect to the external hair-cutting member, the sensor being disposed between the external hair-cutting member and the housing.

5. A shaving apparatus as claimed in claim 1, wherein the haircutting member is formed by at least one wet-shaving blade mounted in a holder, which holder is pivotably connected to the housing, a pressure spring acting between the holder and the housing and said means being disposed between the pivotable holder and the housing.

6. A shaving apparatus as claimed in claim 1, wherein the means comprise a pressure-contact switch, which is arranged in the housing and whose electrical contacts are influenced by the position of the hair-cutting member with respect to the housing.

7. A shaving apparatus as claimed in claim 1 the apparatus comprises a switch for activating and deactivating the sensor.

8. A shaving apparatus comprising a housing and at least one hair-cutting member, wherein the shaving apparatus comprises means for warning the user when a given preset force between the hair-cutting member and the housing is exceeded during shaving, and a counting device for counting the number of times that the preset force is exceeded.

* * * * *